US011871791B2

(12) United States Patent
Liu et al.

(10) Patent No.: US 11,871,791 B2
(45) Date of Patent: Jan. 16, 2024

(54) ATOMIZER AND ELECTRONIC CIGARETTE WITH AN AIR INPUT AMOUNT ADJUSTABLE BY ROTATING A MOUTHPIECE

(71) Applicant: CHINA TOBACCO HUNAN INDUSTRIAL CO., LTD., Hunan (CN)

(72) Inventors: Jianfu Liu, Hunan (CN); Kejun Zhong, Hunan (CN); Xiaoyi Guo, Hunan (CN); Wei Huang, Hunan (CN); Xinqiang Yin, Hunan (CN); Jianhua Yi, Hunan (CN); Chaoxiang Huang, Hunan (CN)

(73) Assignee: CHINA TOBACCO HUNAN INDUSTRIAL CO., LTD., Hunan (CN)

( * ) Notice: Subject to any disclaimer, the term of this patent is extended or adjusted under 35 U.S.C. 154(b) by 541 days.

(21) Appl. No.: 17/272,891

(22) PCT Filed: Sep. 3, 2019

(86) PCT No.: PCT/CN2019/104146
§ 371 (c)(1),
(2) Date: Mar. 2, 2021

(87) PCT Pub. No.: WO2020/048437
PCT Pub. Date: Mar. 12, 2020

(65) Prior Publication Data

US 2021/0212376 A1 Jul. 15, 2021

(30) Foreign Application Priority Data

Sep. 3, 2018 (CN) ..... 201821435144.X

(51) Int. Cl.
*A24F 40/485* (2020.01)
*A24F 40/10* (2020.01)
(Continued)

(52) U.S. Cl.
CPC ..... *A24F 40/485* (2020.01); *A24F 7/00* (2013.01); *A24F 40/10* (2020.01); *A24F 40/42* (2020.01); *A24F 40/60* (2020.01)

(58) Field of Classification Search
CPC ..... A24F 40/485; A24F 40/10; A24F 40/42; A24F 40/60; A24F 7/00
See application file for complete search history.

(56) References Cited

U.S. PATENT DOCUMENTS

2017/0295847 A1* 10/2017 Liu ..... F22B 1/284
2021/0267278 A1* 9/2021 Liu ..... A24F 7/02
2021/0267279 A1* 9/2021 Liu ..... A24F 40/05

FOREIGN PATENT DOCUMENTS

CN 205757200 U 12/2016
CN 206213279 U 6/2017
(Continued)

OTHER PUBLICATIONS

International Search Report issued International Patent Application No. PCT/CN2019/104146 dated Dec. 4, 2019, 3 pages.

*Primary Examiner* — Hae Moon Hyeon
(74) *Attorney, Agent, or Firm* — Mauriel Kapouytian Woods LLP; Ran Pang; Michael Mauriel

(57) ABSTRACT

An atomizer and electronic cigarette are disclosed. The electronic cigarette comprises a shell (1), wherein a top of the shell (1) is connected to a mouthpiece (3) through a mouthpiece holder (2). The mouthpiece holder (2) is provided with an air inlet (201). An air tube (4) is arranged in the shell (1). An air inlet channel (401) is arranged in the air tube (4). A side wall of the air tube (4) is provided with a first air passing hole (402) for communicating the air inlet (201)
(Continued)

with the air inlet channel (401). A top end of the mouthpiece (3) has an extension section (301). A bottom end face of the extension section (301) is provided with a number of step portions (3011) of unequal heights.

20 Claims, 6 Drawing Sheets

(51) Int. Cl.

| | |
|---|---|
| ***A24F 40/42*** | (2020.01) |
| ***A24F 40/60*** | (2020.01) |
| ***A24F 7/00*** | (2006.01) |

(56) References Cited

FOREIGN PATENT DOCUMENTS

| | | | |
|---|---|---|---|
| CN | 206808668 | U | 12/2017 |
| CN | 206949536 | U | 2/2018 |
| CN | 207054794 | U | 3/2018 |
| CN | 208837110 | U | 5/2019 |
| EP | 3 195 738 | A2 | 7/2017 |

* cited by examiner

ATOMIZER AND ELECTRONIC CIGARETTE WITH AN AIR INPUT AMOUNT ADJUSTABLE BY ROTATING A MOUTHPIECE

CROSS REFERENCE TO RELATED APPLICATIONS

This application is a U.S. National Phase application under 35 U.S.C. § 371 of International Application No. PCT/CN2019/104146 filed on Sep. 3, 2019, which claims priority to Chinese Application No. 201821435144.X filed on Sep. 3, 2018. The entire contents of these applications are hereby incorporated herein by reference.

FIELD OF THE INVENTION

The present invention particularly relates to an atomizer and electronic cigarette.

BACKGROUND OF THE INVENTION

The existing atomizer comprises a shell, a mouthpiece holder is arranged at a top of the shell, a mouthpiece is connected to the mouthpiece holder, and the mouthpiece holder is provided with an air inlet; an air inlet channel, an air outlet channel, a smoke producing unit, and an atomization unit for atomizing the smoke producing unit to obtain smoke are arranged in the shell; and the air inlet, the air inlet channel, the smoke producing unit, the air outlet channel, and the mouthpiece are sequentially communicated. When the atomizer is operating, air enters from the air inlet, passes through the air inlet channel to take away the smoke produced by the smoke producing unit, and the smoke enters the user's mouth through the air outlet channel and the mouthpiece in turn.

In order to meet the needs of users with different lung capacities, the air flow of the air channel needs to be adjusted. The general solution is that an air adjusting ring is sleeved on the mouthpiece holder at a position corresponding to the air inlet, the air adjusting ring is provided with an air adjusting hole, and the air adjusting ring is rotated to adjust the alignment area between the air adjusting hole and the air inlet, so as to adjust the amount of the air flow of the air flow channel.

The existing atomizer with such a structure has the following disadvantages:

First, the area of a hand-held portion of the air adjusting ring is small, and in the process of rotating to adjust air, it is difficult to apply force, so the adjustment force cannot be well controlled, it is not easy to adjust to obtain appropriate amount of air input, the operation is inconvenient, and the user experience is poor.

Second, if the mouthpiece holder serves as an e-liquid filling cover, it is easy to open the e-liquid filling cover by mistake during air adjustment, causing e-liquid to leak out. In addition, as negative pressure condition does not exist in an e-liquid bin after the e-liquid filling cover is opened, e-liquid guiding cotton guides the e-liquid too fast, so that it is easy to suck the e-liquid.

Third, the air inlet channel and the air outlet channel are not completely isolated, causing the smoke to taste not full and delicate enough.

SUMMARY OF THE INVENTION

In response to the above shortcomings of the prior art, an objective of the present invention is to provide an atomizer and electronic cigarette, in which the air input amount can be adjusted by rotating a mouthpiece, so the operation is simple and convenient, the force is easy to control, and the user experience is good.

In order to solve the above technical problems, the technical solution adopted by the present invention is:

An atomizer comprises a shell, a mouthpiece holder is arranged at a top of the shell, a mouthpiece is connected to the mouthpiece holder, the mouthpiece holder is provided with an air inlet, an air tube is arranged in the shell, an air inlet channel is arranged in the air tube, and a side wall of the air tube is provided with a first air passing hole for communicating the air inlet with the air inlet channel, the structural characteristics of the atomizer is that a top end of the mouthpiece has an extension section extending toward an inner cavity of the mouthpiece, a bottom end face of the extension section is circumferentially provided with a number of step portions of unequal heights, a top end of the air tube has a support portion abutting against any step portion, the mouthpiece is in clearance fit with the mouthpiece holder and is rotatable circumferentially, and the atomizer further comprises a guiding mechanism that guides the air tube to move axially and limits circumferential rotation of the air tube when the mouthpiece rotates circumferentially; and the axial movement of the air tube changes the alignment area between the air inlet and the first air passing hole.

With the above structure, when the air input amount needs to be adjusted, the mouthpiece is rotated. The bottom end face of the extension section of the mouthpiece is circumferentially provided with a number of step portions of unequal heights, the top end of the air tube has a support portion abutting against any step portion, the guiding mechanism guides the air tube to move axially and limits circumferential rotation of the air tube when the mouthpiece rotates circumferentially, and when the mouthpiece rotates, the air tube moves axially up and down, thereby changing the alignment area between the air inlet and the first air passing hole. Each step portion corresponds to an adjustment level, thereby realizing multi-level adjustment of the air input amount. In the present invention, since the force is act on the mouthpiece when adjusting air amount, the operation is simple and convenient, the force is easy to control, and the user experience is good.

As a preferred mode, the guiding mechanism comprises an air inlet seat sleeved between the air tube and the mouthpiece holder, the air inlet seat is provided with a second air passing hole for communicating the air inlet with the first air passing hole, an outer wall of the air tube is provided with a first limiting plane, and an inner wall of the air inlet seat is provided with a second limiting plane matching the first limiting plane. The first limiting plane is coordinated with the second limiting plane, thus the circumferential rotation of the air tube can be limited, and the air tube can be guided to move axially up and down when the mouthpiece rotates.

Further, the guiding mechanism further comprises a sealing seat sleeved between the air inlet seat and the air tube, the air inlet seat is buckled with the sealing seat, and an inner wall of the sealing seat is provided with a third limiting plane matching the first limiting plane.

The arrangement of the sealing seat can ensure air tightness of the air path and prevent air leakage.

Further, the atomizer further comprises a turntable and a compression spring, an outer wall of the turntable is fixedly connected with an inner wall of the mouthpiece, the mouthpiece is in clearance fit with an outer wall of the mouthpiece holder, and the turntable is in clearance fit with an inner wall of the mouthpiece holder; the compression spring and the turntable are both sleeved on the air tube, a bottom of the compression spring is arranged in a limit slot of the turntable, and a top of the compression spring abuts against a limiting flange at a bottom end of the air tube.

The turntable is fixedly connected with the mouthpiece to form a rotating body, the mouthpiece is in clearance fit with the outer wall of the mouthpiece holder, and the turntable is in clearance fit with an inner wall of the mouthpiece holder, so that the rotating body can rotate 360° about the axis of the mouthpiece holder.

The arrangement of the compression spring can ensure the reliable abutment between the support portion and the step portion and ensure that the air adjustment function can be realized.

As a preferred mode, an e-liquid bin is arranged in the shell, and the mouthpiece holder is provided with an e-liquid filling hole for filling e-liquid into the e-liquid bin.

Since both of the mouthpiece and the turntable are in clearance fit with the mouthpiece holder, when the rotating body rotates, it will not drive the mouthpiece holder to rotate. The mouthpiece holder also serves as an e-liquid filling cover, so the e-liquid filling cover will not be opened by mistake during the air adjustment process.

Further, an air outlet channel communicated with the mouthpiece is further arranged in the air tube, the side wall of the air tube is provided with a third air passing hole for communicating the air inlet channel with the air outlet channel, and an isolation layer for isolating the air outlet channel from the air inlet channel is arranged in the air tube. With the above structure, the air inlet channel and the air outlet channel in the air tube are completely sealed and isolated, and air flows through the air inlet channel, the ultrasonic atomization sheet, the air outlet channel and the mouthpiece, so that the smoke atomized by the ultrasonic atomization sheet can be taken away and the smoke tastes full and delicate.

Further, both sides of the bottom surface of each step portion have chamfered corners connected to bottom surfaces of the adjacent step portions in a smooth transition manner.

With the chamfered corners, the support portion can slide between the inlet air adjustment levels smoother.

As a preferred mode, the inner wall of the sealing seat is provided with at least one clamping groove, and the air inlet seat has a hook matching the clamping groove.

During assembly, the clamping groove on the sealing seat is clamped with the hook on the air inlet seat, so that the air inlet and the air inlet channel are better communicated, the sealing seat and the air inlet seat are well sealed and form a whole, and the assembly is convenient and time-saving.

As a preferred mode, the mouthpiece is riveted with the turntable.

As a preferred mode, the height of the support portion ranges from 1 mm to 15 mm, and the thickness of the bottom end of the extension section ranges from 3 mm to 8 mm. With this structure, a first cavity with a large space capacity and a diameter greater than the inner diameter of the extension section is formed between the top end of the air tube and the bottom end of the extension section, so that the flow velocity of smoke in the first cavity is relatively slow, large granular droplets in the smoke are easily condensed in the first cavity, the user is prevented from sucking large granular e-liquid droplets, and the smoke tastes good and does not burn the mouth. The e-liquid droplets condensed in the first cavity flow along the inner wall of the turntable into the second cavity between the turntable and the air tube. When a lot of e-liquid droplets in the second cavity are accumulated with service time, the accumulated e-liquid droplets can be thrown out by shaking the mouthpiece.

Based on the same inventive concept, the present invention further provides electronic cigarette, comprising the atomizer.

Compared with the prior art, the present invention has the advantages that the air input amount can be adjusted by rotating the mouthpiece, so the operation is simple and convenient, and the force when adjusting air amount is easy to control; the e-liquid filling cover will not be opened by mistake during the air adjustment process; the air inlet channel and the air outlet channel are completely isolated, so the air channel has good sealing performance, the smoke tastes full and delicate, and the user experience is good.

Figure 1:
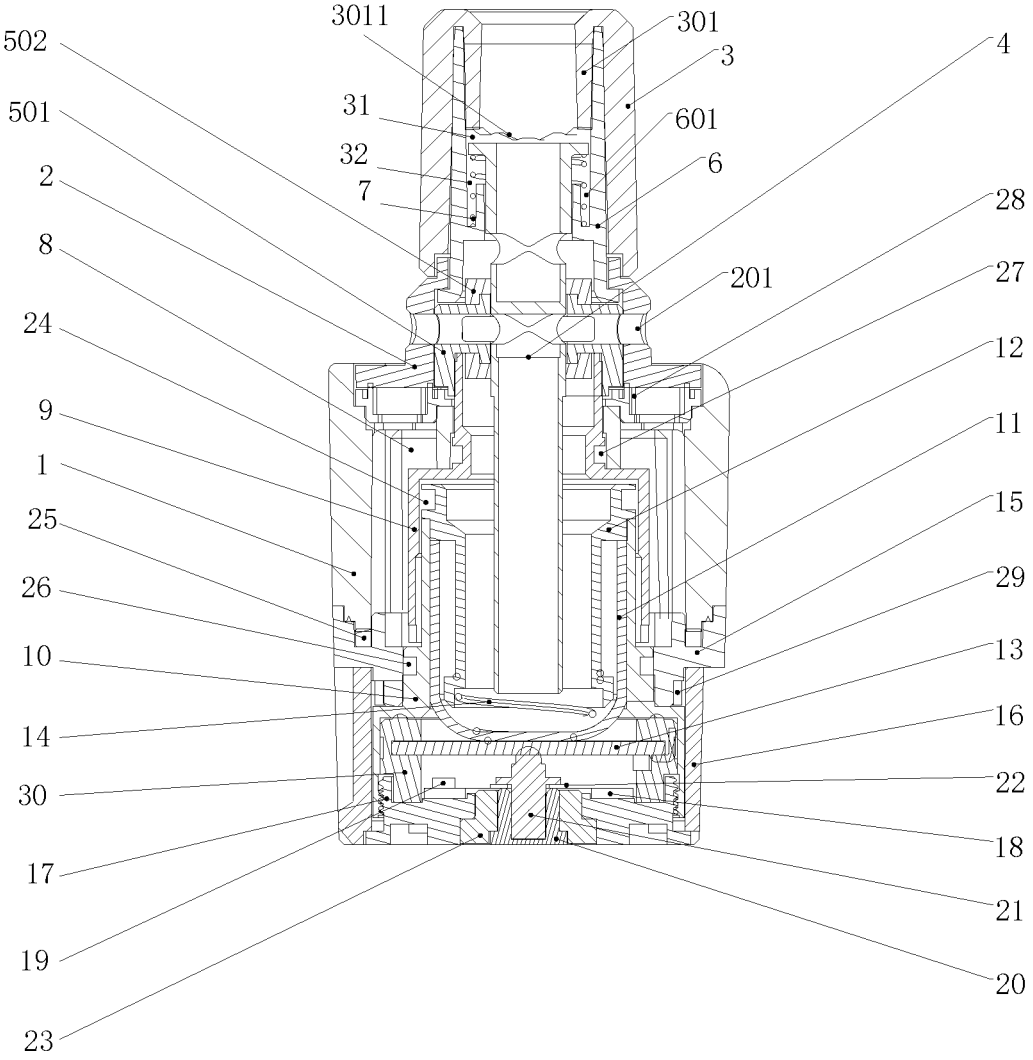
FIG. 1 is a front cross-sectional view of an embodiment of an atomizer.
Figure 2:
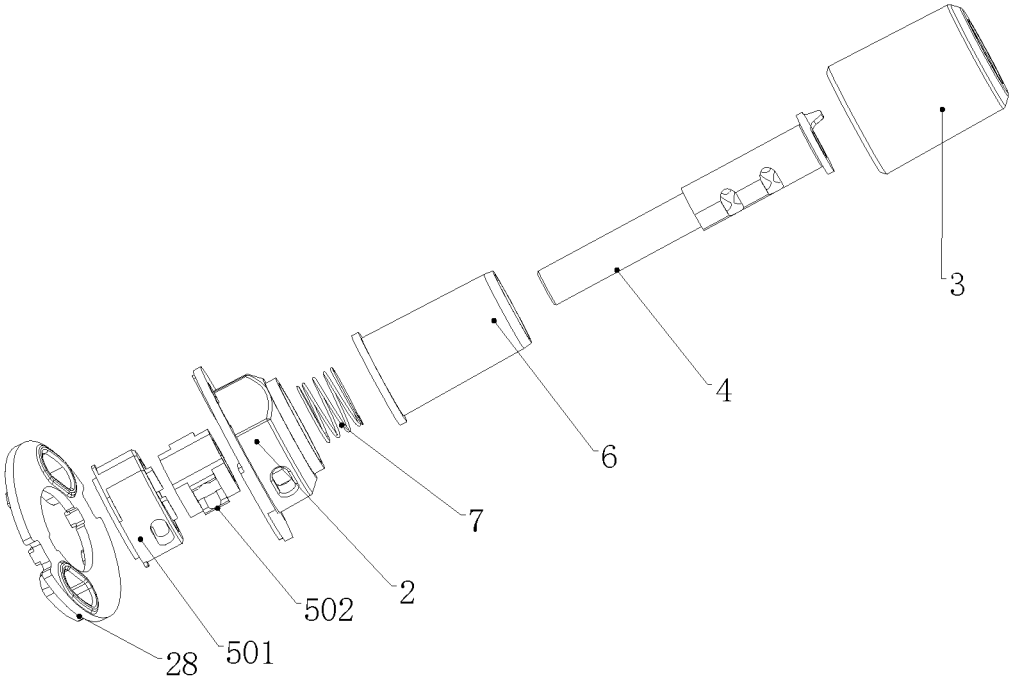
FIG. 2 is an exploded view of the upper part in FIG. 1.
Figure 3:
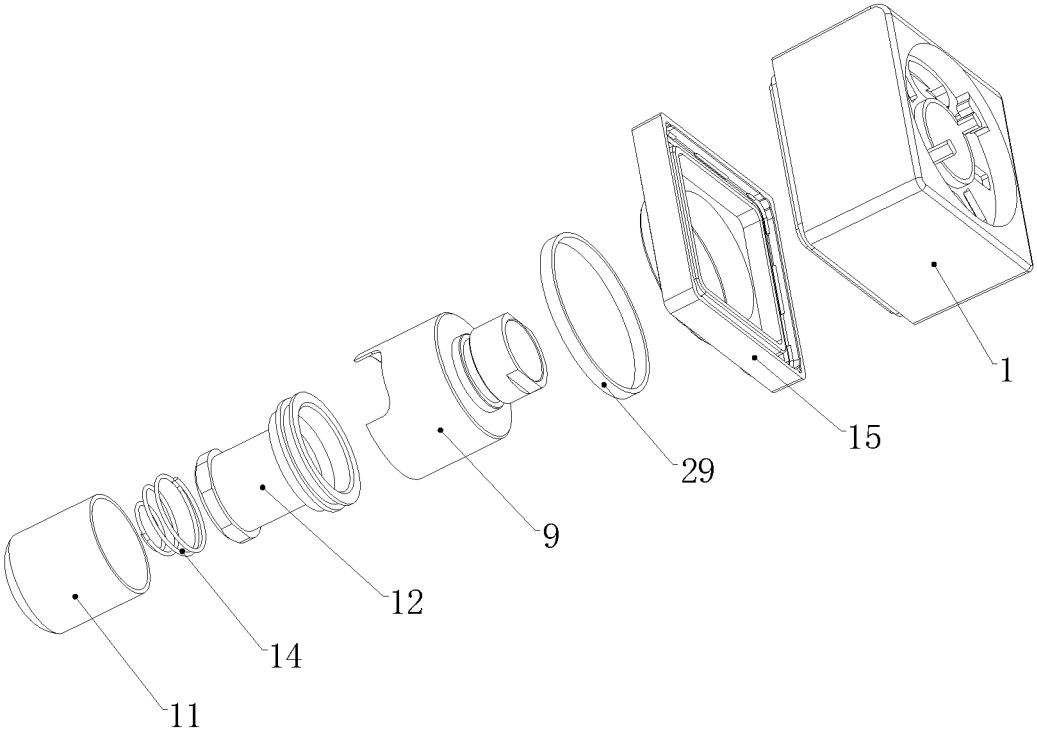
FIG. 3 is an exploded view of the middle part in FIG. 1.
Figure 4:
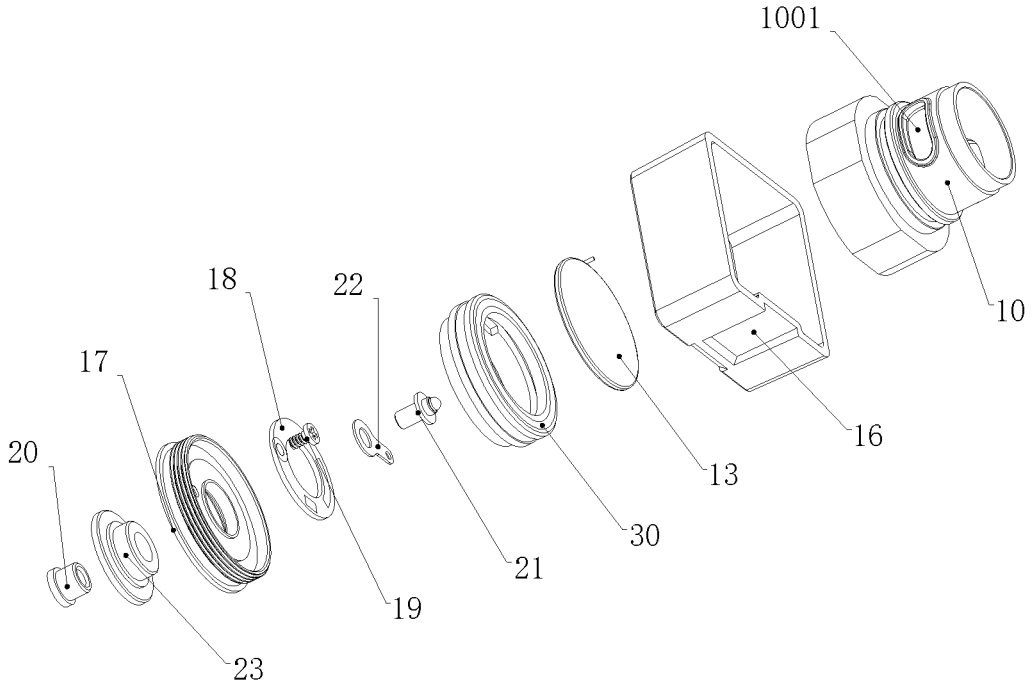
FIG. 4 is an exploded view of the lower part in FIG. 1.
Figure 5:
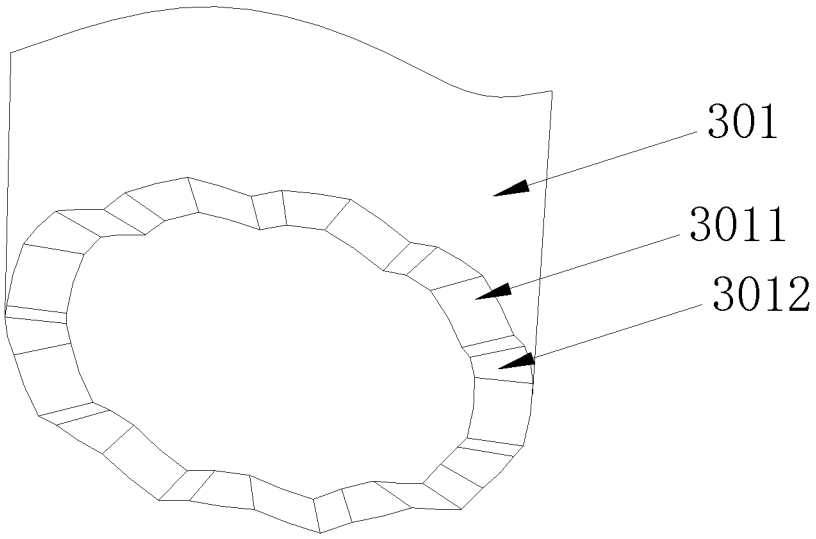
FIG. 5 is a schematic structural diagram of a lower section of an extension section.
Figure 6:
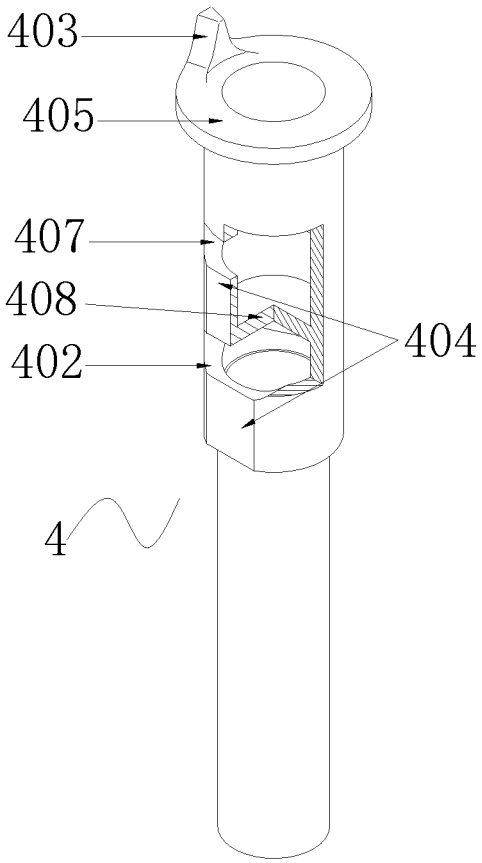
FIG. 6 is a schematic structural diagram of an air tube.
Figure 7:
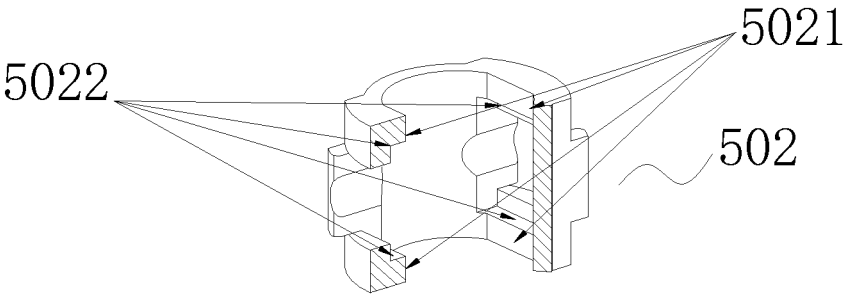
FIG. 7 is a schematic structural diagram of a sealing seat.
Figure 8:
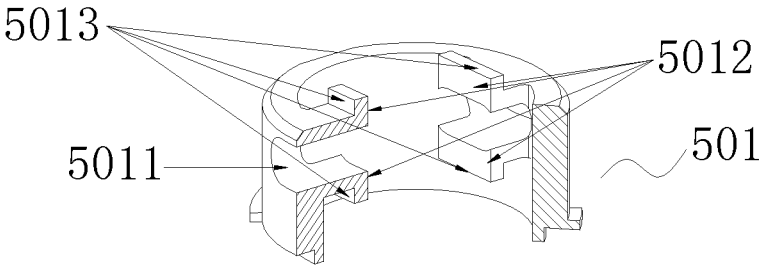
FIG. 8 is a schematic structural diagram of an air inlet seat.
Figure 9:
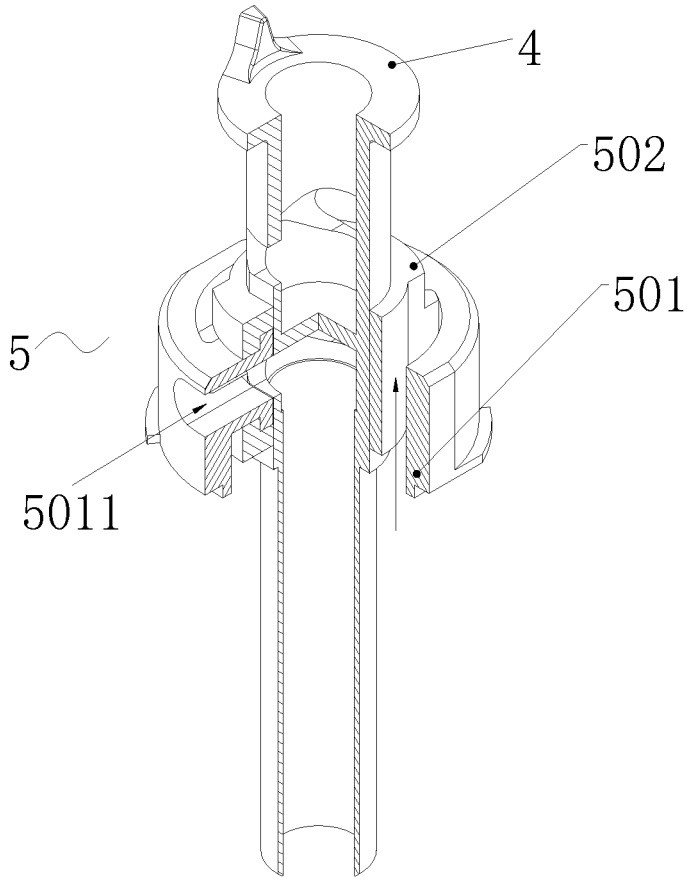
FIG. 9 is a schematic diagram showing the connection relationship between a guiding structure and the air tube.

In the figures: 1 shell, 2 mouthpiece holder, 201 air inlet, 202 e-liquid filling hole, 3 mouthpiece, 301 extension section, 3011 step portion, 3012 chamfered corner, 4 air tube, 401 air inlet channel, 402 first air passing hole, 403 support portion, 404 first limiting plane, 405 limiting flange, 406 air outlet channel, 407 third air passing hole, 408 isolation layer, 5 guiding mechanism, 501 air inlet seat, 5011 second air passing hole, 5012 second limiting plane, 5013 hook, 502 sealing seat, 5021 third limiting plane, 5022 clamping groove, 6 turntable, 601 limit slot, 7 compression spring, 8 e-liquid bin, 9 atomization sleeve, 10 outer sleeve, 1001 e-liquid passing hole, 11 e-liquid guiding cotton, 12 inner sleeve, 13 ultrasonic atomization sheet, 14 cotton pressing spring, 15 base, 16 bottom cover, 17 threaded ring, 18 PCB, 19 screw, 20 electrode sleeve, 21 elastic electrode, 22 conductive sheet, 23 insulating ring, 24 first sealing ring, 25 second sealing ring, 26 third sealing ring, 27 fourth sealing ring, 28 gasket, 29 compression ring, 30 silica gel seat, 31 first cavity, 32 second cavity.

DETAILED DESCRIPTION OF EMBODIMENTS

As shown in FIGS. 1-9, an atomizer in electronic cigarette according to the present invention comprises a shell 1, a mouthpiece holder 2 is arranged at a top of the shell 1, a mouthpiece 3 is connected to the mouthpiece holder 2, the mouthpiece holder 2 is provided with an air inlet 201, an air tube 4 is arranged in the shell 1, an air inlet channel 401 (see FIG. 10) is arranged in the air tube 4, a side wall of the air tube 4 is provided with a first air passing hole 402 (see FIG. 6) for communicating the air inlet 201 with the air inlet channel 401, a top end of the mouthpiece 3 has an extension section 301 extending toward an inner cavity of the mouthpiece 3, a bottom end face of the extension section 301 is circumferentially provided with a number of step portions 3011 of unequal heights, a top end of the air tube 4 has a support portion 403 abutting against any step portion 3011, the mouthpiece 3 is in clearance fit with the mouthpiece holder 2 and is rotatable circumferentially, and the atomizer further comprises a guiding mechanism 5 (see FIG. 9) that guides the air tube 4 to move axially and limits circumferential rotation of the air tube 4 when the mouthpiece 3 rotates circumferentially; and the axial movement of the air tube 4 changes the alignment area between the air inlet 201 and the first air passing hole 402.

When the air input amount needs to be adjusted, the mouthpiece 3 is rotated. The bottom end face of the extension section 301 of the mouthpiece 3 is circumferentially provided with a number of step portions 3011 of unequal heights, the top end of the air tube 4 has a support portion 403 abutting against any step portion 3011, the guiding mechanism 5 guides the air tube 4 to move axially and limits circumferential rotation of the air tube 4 when the mouthpiece 3 rotates circumferentially, and when the mouthpiece 3 rotates, the air tube 4 moves axially up and down, thereby changing the alignment area between the air inlet 201 and the first air passing hole 402. Each step portion 3011 corresponds to an adjustment level, thereby realizing multi-level adjustment of the air input amount. In the present invention, since the force is act on the mouthpiece 3 when adjusting air amount, the operation is simple and convenient, the force is easy to control, and the user experience is good.

The guiding mechanism 5 comprises an air inlet seat 501 sleeved between the air tube 4 and the mouthpiece holder 2, the air inlet seat 501 is provided with a second air passing hole 5011 for communicating the air inlet 201 with the first air passing hole 402, an outer wall of the air tube 4 is provided with a first limiting plane 404, and an inner wall of the air inlet seat 501 is provided with a second limiting plane 5012 matching the first limiting plane 404.

The first limiting plane 404 is coordinated with the second limiting plane 5012, thus the circumferential rotation of the air tube 4 can be limited, and the air tube 4 can be guided to move axially up and down when the mouthpiece 3 rotates.

The guiding mechanism 5 further comprises a sealing seat 502 sleeved between the air inlet seat 501 and the air tube 4, and the sealing seat 502 is made of silica gel. The air inlet seat 501 is buckled with the sealing seat 502, so that the air inlet seat 501 and the sealing seat 502 are hermetically connected into a whole to facilitate assembly; and an inner wall of the sealing seat 502 is provided with a third limiting plane 5021 matching the first limiting plane 404. The arrangement of the sealing seat 502 can ensure that the air path formed by the air inlet seat 501 and the air tube 4 has good sealing performance after the sealing seat 502 is sleeved on the air tube 4, so as to prevent air leakage.

The atomizer further comprises a turntable 6 and a compression spring 7, an outer wall of the turntable 6 is fixedly connected with an inner wall of the mouthpiece 3, and the mouthpiece 3 is riveted with the turntable 6. The mouthpiece 3 is in clearance fit with an outer wall of the mouthpiece holder 2, and the turntable 6 is in clearance fit with an inner wall of the mouthpiece holder 2; the compression spring 7 and the turntable 6 are both sleeved on the air tube 4, a bottom of the compression spring 7 is arranged in a limit slot 601 of the turntable 6, and a top of the compression spring 7 abuts against a limiting flange 405 at a bottom end of the air tube 4.

The height of the support portion 403 ranges from 1 mm to 15 mm, and the thickness of the bottom end of the extension section 301 ranges from 3 mm to 8 mm. With this structure, a first cavity 31 with a large space capacity and a diameter greater than the inner diameter of the extension section 301 is formed between the top end of the air tube 4 and the bottom end of the extension section 301, so that the flow velocity of smoke in the first cavity 31 is relatively slow, large granular droplets in the smoke are easily condensed in the first cavity 31, the user is prevented from sucking large granular e-liquid droplets, and the smoke tastes good and does not burn the mouth. The e-liquid droplets condensed in the first cavity 31 flow along the inner wall of the turntable 6 into the second cavity 32 between the turntable 6 and the air tube 4. When a lot of e-liquid droplets in the second cavity 32 are accumulated with time, the accumulated e-liquid droplets can be thrown out by shaking the mouthpiece 3.

The turntable 6 is fixedly connected with the mouthpiece 3 to form a rotating body, the mouthpiece 3 is in clearance fit with the outer wall of the mouthpiece holder 2, and a boss (not marked in the figure) is provided at the bottom of the turntable 6. The clamping and clearance fit between the boss and the inner wall of the mouthpiece holder 2 can ensure that the rotating body does not drop when rotating 360° about the axis of the mouthpiece holder 2.

The arrangement of the compression spring 7 can ensure the reliable abutment between the support portion 403 and the step portion 3011 and ensure that the air adjustment function can be realized.

An e-liquid bin 8 is arranged in the shell 1, and the mouthpiece holder 2 is provided with an e-liquid filling hole 202 for filling e-liquid into the e-liquid bin 8.

Since both of the mouthpiece 3 and the turntable 6 are in clearance fit with the mouthpiece holder 2, when the rotating body rotates, it will not drive the mouthpiece holder 2 to rotate. The mouthpiece holder 2 also serves as an e-liquid filling cover, so the e-liquid filling cover will not be opened by mistake during the air adjustment process.

An air outlet channel 406 (see FIG. 10) communicated with the mouthpiece 3 is further arranged in the air tube 4, the side wall of the air tube 4 is provided with a third air passing hole 407 for communicating the air inlet channel 401 with the air outlet channel 406, and an isolation layer 408 for isolating the air outlet channel 406 from the air inlet channel 401 is arranged in the air tube 4, so that the air inlet channel 401 and the air outlet channel 406 in the air tube 4 are completely sealed and isolated, the smoke is taken out more fully and the smoke tastes full and delicate.

Both sides of the bottom surface of each step portion 3011 have chamfered corners 3012 connected to bottom surfaces of the adjacent step portions 3011 in a smooth transition manner. With the chamfered corners 3012, the transition of the support portion 403 between the inlet air adjustment levels is smoother.

The inner wall of the sealing seat 502 is provided with four clamping grooves 5022, and the air inlet seat 501 has four hooks 5013 matching the four clamping grooves 5022 one by one.

An atomization sleeve 9 is further arranged in the shell 1, and a top end of the atomization sleeve 9 is fixedly connected with the air inlet seat 501. The e-liquid bin 8 is formed between the atomization sleeve 9 and the shell 1.

An outer sleeve 10, cup-shaped e-liquid guiding cotton 11 and an inner sleeve 12 are arranged in the atomization sleeve 9, and a side wall of the e-liquid guiding cotton 11 is sleeved between an upper section of the outer sleeve 10 and a lower section of the inner sleeve 12. The outer sleeve 10 is provided with an e-liquid passing hole 1001 for communicating the e-liquid bin 8 with the e-liquid guiding cotton 11.

The atomizer further comprises an ultrasonic atomization sheet 13, and the ultrasonic atomization sheet 13 is fixed in a lower section of the outer sleeve 10 through a silica gel seat 30. An outer bottom surface of the e-liquid guiding cotton 11 is in contact with an atomization surface of the ultrasonic atomization sheet 13. A cotton pressing spring 14 is arranged in the e-liquid guiding cotton 11, one end of the cotton pressing spring 14 abuts against the inner sleeve 12, and the other end of the cotton pressing spring 14 abuts against an inner bottom surface of the e-liquid guiding cotton 11, so that the e-liquid guiding cotton 11 contacts the ultrasonic atomization sheet 13 reliably to guide e-liquid smoothly.

A bottom end of the shell 1 is connected to a bottom cover 16 through a base 15. A threaded ring 17 is arranged in the bottom cover 16, and a Printed Circuit Board (PCB) 18 is fixed on the threaded ring 17 by screws 19. An electrode sleeve 20 is further arranged on the threaded ring 17, and the electrode sleeve 20 abuts against an electrode layer of the ultrasonic atomization sheet 13 through an elastic electrode 21. The elastic electrode 21 is electrically connected to the PCB 18 through a conductive sheet 22. The threaded ring 17 is connected to the electrode sleeve 20 by insulation of an insulating ring 23.

A first sealing ring 24 is arranged between the inner sleeve 12 and the atomization sleeve 9. A second sealing ring 25 is arranged between the shell 1 and the base 15. A third sealing ring 26 is arranged between the outer sleeve 10 and the base 15. A fourth sealing ring 27 is arranged between the atomization sleeve 9 and the shell 1. A gasket 28 is arranged between the mouthpiece holder 2 and the e-liquid bin 8. A compression ring 29 is arranged between the base 15 and the bottom cover 16.

Figure 10:
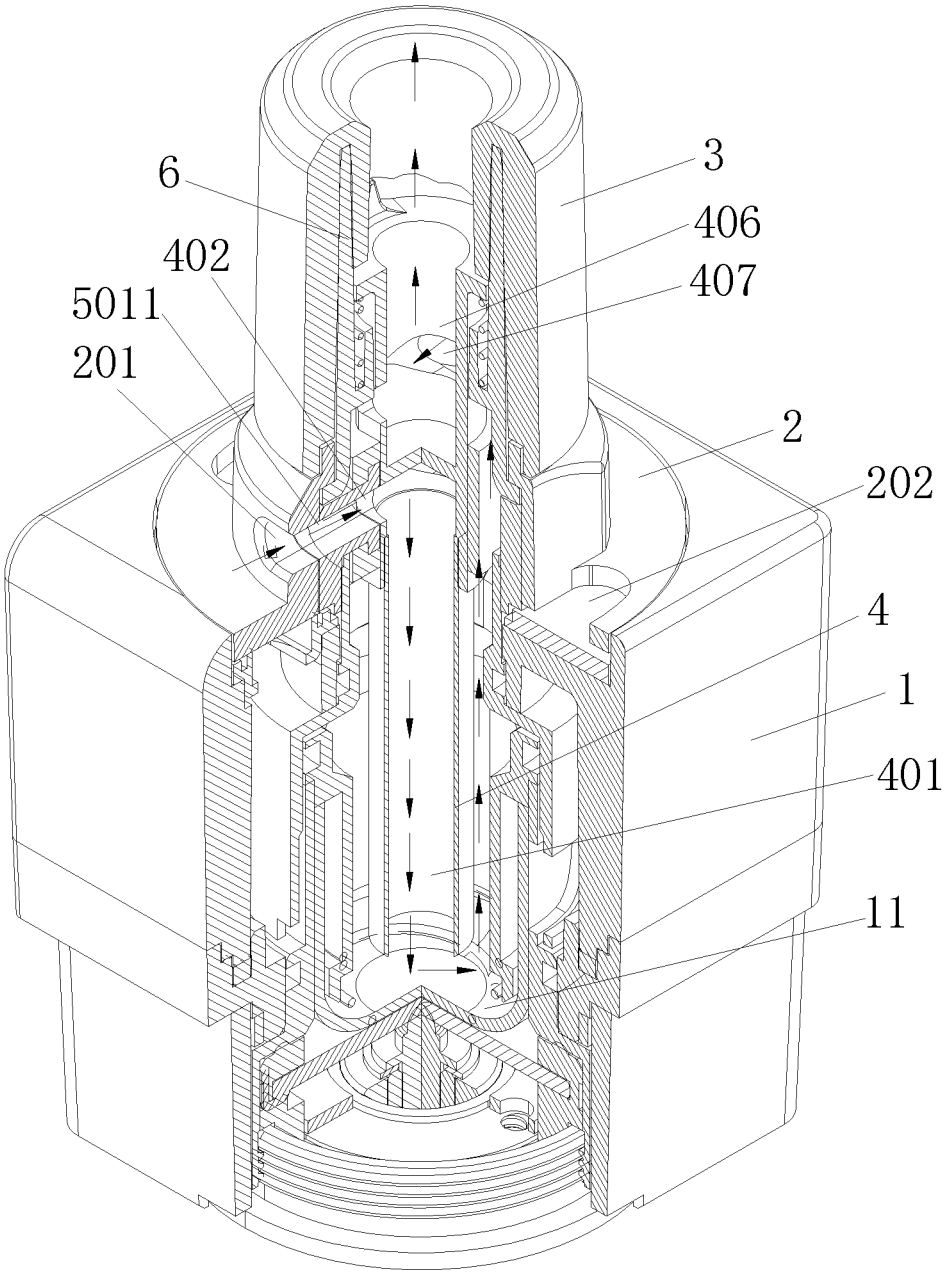
FIG. 10 is a schematic diagram showing the air flow direction in the atomizer.

As shown in FIG. 10, when the atomizer is operating, air enters from the air inlet 201, passes through the second air passing hole 5011, the first air passing hole 402 and the air inlet channel 401 in turn, and reaches the e-liquid guiding cotton 11 to carry smoke into the user's mouth from the third air passing hole 407, the air outlet channel 406 and the mouthpiece 3 in turn.

The embodiments of the present invention are described above with reference to the drawings, but the present invention is not limited to the specific embodiments. The specific embodiments described above are merely illustrative but not limited. Many forms may also be made by those of ordinary skill in the art under the enlightenment of the present invention without departing from the purpose of the present invention and the scope of the claims, and these forms fall into the scope of the present invention.

The invention claimed is:

1. An atomizer, comprising a shell (1), wherein:

a mouthpiece holder (2) is arranged at a top of the shell (1), a mouthpiece (3) is connected to the mouthpiece holder (2), the mouthpiece holder (2) is provided with an air inlet (201), an air tube (4) is arranged in the shell (1), an air inlet channel (401) is arranged in the air tube (4), and a side wall of the air tube (4) is provided with a first air passing hole (402) for communicating the air inlet (201) with the air inlet channel (401), a top end of the mouthpiece (3) has an extension section (301) extending toward an inner cavity of the mouthpiece (3), a bottom end face of the extension section (301) is circumferentially provided with a number of step portions (3011) of unequal heights, a top end of the air tube (4) has a support portion (403) abutting against any step portion (3011), the mouthpiece (3) is in clearance fit with the mouthpiece holder (2) and is rotatable circumferentially, and the atomizer further comprises a guiding mechanism (5) that guides the air tube (4) to move axially and limits circumferential rotation of the air tube (4) when the mouthpiece (3) rotates circumferentially; and the axial movement of the air tube (4) changes the alignment area between the air inlet (201) and the first air passing hole (402).

2. The atomizer according to claim 1, wherein the guiding mechanism (5) comprises an air inlet seat (501) sleeved between the air tube (4) and the mouthpiece holder (2), wherein:

the air inlet seat (501) is provided with a second air passing hole (5011) for communicating the air inlet (201) with the first air passing hole (402), an outer wall of the air tube (4) is provided with a first limiting plane (404), and an inner wall of the air inlet seat (501) is provided with a second limiting plane (5012) matching the first limiting plane (404).

3. The atomizer according to claim 2, wherein the guiding mechanism (5) further comprises a sealing seat (502) sleeved between the air inlet seat (501) and the air tube (4), wherein:

the air inlet seat (501) is buckled with the sealing seat (502), and an inner wall of the sealing seat (502) is provided with a third limiting plane (5021) matching the first limiting plane (404).

4. The atomizer according to claim 3, further comprising a turntable (6) and a compression spring (7), wherein:

an outer wall of the turntable (6) is fixedly connected with an inner wall of the mouthpiece (3), the mouthpiece (3) is in clearance fit with an outer wall of the mouthpiece holder (2), and the turntable (6) is in clearance fit with an inner wall of the mouthpiece holder (2);

the compression spring (7) and the turntable (6) are both sleeved on the air tube (4), a bottom of the compression spring (7) is arranged in a limit slot (601) of the turntable (6), and a top of the compression spring (7) abuts against a limiting flange (405) at a bottom end of the air tube (4).

5. The atomizer according to claim 3, wherein:

an e-liquid bin (8) is arranged in the shell (1), and the mouthpiece holder (2) is provided with an e-liquid filling hole (202) for filling e-liquid into the e-liquid bin (8).

6. The atomizer according to claim 3, wherein:

an air outlet channel (406) communicated with the mouthpiece (3) is further arranged in the air tube (4), the side wall of the air tube (4) is provided with a third air passing hole (407) for communicating the air inlet channel (401) with the air outlet channel (406), and an isolation layer (408) for isolating the air outlet channel (406) from the air inlet channel (401) is arranged in the air tube (4).

7. The atomizer according to claim 3, wherein the inner wall of the sealing seat (502) is provided with at least one clamping groove (5022), and the air inlet seat (501) has a hook (5013) matching the clamping groove (5022).

8. The atomizer according to claim 2, further comprising a turntable (6) and a compression spring (7), wherein:

an outer wall of the turntable (6) is fixedly connected with an inner wall of the mouthpiece (3), the mouthpiece (3) is in clearance fit with an outer wall of the mouthpiece holder (2), and the turntable (6) is in clearance fit with an inner wall of the mouthpiece holder (2);

the compression spring (7) and the turntable (6) are both sleeved on the air tube (4), a bottom of the compression spring (7) is arranged in a limit slot (601) of the turntable (6), and a top of the compression spring (7) abuts against a limiting flange (405) at a bottom end of the air tube (4).

9. The atomizer according to claim 2, wherein:

an e-liquid bin (8) is arranged in the shell (1), and the mouthpiece holder (2) is provided with an e-liquid filling hole (202) for filling e-liquid into the e-liquid bin (8).

10. The atomizer according to claim 2, wherein:

an air outlet channel (406) communicated with the mouthpiece (3) is further arranged in the air tube (4), the side wall of the air tube (4) is provided with a third air passing hole (407) for communicating the air inlet channel (401) with the air outlet channel (406), and an isolation layer (408) for isolating the air outlet channel (406) from the air inlet channel (401) is arranged in the air tube (4).

11. The atomizer according to claim 1, further comprising a turntable (6) and a compression spring (7), wherein:

an outer wall of the turntable (6) is fixedly connected with an inner wall of the mouthpiece (3), the mouthpiece (3) is in clearance fit with an outer wall of the mouthpiece holder (2), and the turntable (6) is in clearance fit with an inner wall of the mouthpiece holder (2);

the compression spring (7) and the turntable (6) are both sleeved on the air tube (4), a bottom of the compression spring (7) is arranged in a limit slot (601) of the turntable (6), and a top of the compression spring (7) abuts against a limiting flange (405) at a bottom end of the air tube (4).

12. The atomizer according to claim 11, wherein the mouthpiece (3) is riveted with the turntable (6).

13. The atomizer according to claim 1, wherein:

an e-liquid bin (8) is arranged in the shell (1), and the mouthpiece holder (2) is provided with an e-liquid filling hole (202) for filling e-liquid into the e-liquid bin (8).

14. The atomizer according to claim 1, wherein:

an air outlet channel (406) communicated with the mouthpiece (3) is further arranged in the air tube (4), the side wall of the air tube (4) is provided with a third air passing hole (407) for communicating the air inlet channel (401) with the air outlet channel (406), and an isolation layer (408) for isolating the air outlet channel (406) from the air inlet channel (401) is arranged in the air tube (4).

15. The atomizer according to claim 1, wherein both sides of the bottom surface of each step portion (3011) have chamfered corners (3012) connected to bottom surfaces of the adjacent step portions (3011) in a smooth transition manner.

16. The atomizer according to claim 1, wherein:

the height of the support portion (403) ranges from 1 mm to 15 mm, and the thickness of the bottom end of the extension section (301) ranges from 3 mm to 8 mm.

17. An electronic cigarette, comprising an atomizer, the atomizer comprising a shell (1), wherein:

a mouthpiece holder (2) is arranged at a top of the shell (1), a mouthpiece (3) is connected to the mouthpiece holder (2), the mouthpiece holder (2) is provided with an air inlet (201), an air tube (4) is arranged in the shell (1), an air inlet channel (401) is arranged in the air tube (4), a side wall of the air tube (4) is provided with a first air passing hole (402) for communicating the air inlet (201) with the air inlet channel (401), a top end of the mouthpiece (3) has an extension section (301) extending toward an inner cavity of the mouthpiece (3), a bottom end face of the extension section (301) is circumferentially provided with a number of step portions (3011) of unequal heights, a top end of the air tube (4) has a support portion (403) abutting against any step portion (3011), the mouthpiece (3) is in clearance fit with the mouthpiece holder (2) and is rotatable circumferentially, the atomizer further comprises a guiding mechanism (5) that guides the air tube (4) to move axially and limits circumferential rotation of the air tube (4) when the mouthpiece (3) rotates circumferentially; and the axial movement of the air tube (4) changes the alignment area between the air inlet (201) and the first air passing hole (402).

18. The electronic cigarette according to claim 17, wherein:

the guiding mechanism (5) comprises an air inlet seat (501) sleeved between the air tube (4) and the mouthpiece holder (2), the air inlet seat (501) is provided with a second air passing hole (5011) for communicating the air inlet (201) with the first air passing hole (402), an outer wall of the air tube (4) is provided with a first limiting plane (404), and an inner wall of the air inlet seat (501) is provided with a second limiting plane (5012) matching the first limiting plane (404).

19. The electronic cigarette according to claim 17, further comprising a turntable (6) and a compression spring (7), wherein:

an outer wall of the turntable (6) is fixedly connected with an inner wall of the mouthpiece (3), the mouthpiece (3) is in clearance fit with an outer wall of the mouthpiece holder (2), and the turntable (6) is in clearance fit with an inner wall of the mouthpiece holder (2);

the compression spring (7) and the turntable (6) are both sleeved on the air tube (4), a bottom of the compression spring (7) is arranged in a limit slot (601) of the turntable (6), and a top of the compression spring (7) abuts against a limiting flange (405) at a bottom end of the air tube (4).

20. The electronic cigarette according to claim 17, wherein:

an air outlet channel (406) communicated with the mouthpiece (3) is further arranged in the air tube (4), the side wall of the air tube (4) is provided with a third air passing hole (407) for communicating the air inlet channel (401) with the air outlet channel (406), and an isolation layer (408) for isolating the air outlet channel (406) from the air inlet channel (401) is arranged in the air tube (4).

* * * * *